US006589724B1

(12) United States Patent
Singer et al.

(10) Patent No.: US 6,589,724 B1
(45) Date of Patent: Jul. 8, 2003

(54) COLOR PHOTOGRAPHIC ELEMENT CONTAINING SPEED-IMPROVING BENZOTRIAZOLE POLYMER

(75) Inventors: Stephen P. Singer, Spencerport, NY (US); David S. Ross, Rochester, NY (US); Bernard A. Clark, Maidenhead (GB); Philip A. Allway, Rickmansworth (GB); David B. Bailey, Webster, NY (US); Louis E. Friedrich, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/001,522

(22) Filed: Oct. 24, 2001

(51) Int. Cl.[7] ..... G03C 1/04
(52) U.S. Cl. ..... 430/627
(58) Field of Search ..... 430/627

(56) References Cited

U.S. PATENT DOCUMENTS 4,528,264 A 7/1985 Ishiguro et al. ..... 430/609

FOREIGN PATENT DOCUMENTS

JP 11-184040 * 7/1999

OTHER PUBLICATIONS

P. A. Allway et al, "Color Photographic Element Containing Speed Improving Compound", U.S. patent application Ser. No. 09/358,057 (D–78393) filed Jul. 21, 1999.
P. A. Allway et al, "Color Photographic Element Containing Speed–Improving Polymer", U.S. patent application Ser. No. 09/540,808 (D–80060) filed Mar. 31, 2000.

* cited by examiner

*Primary Examiner*—Hoa Van Le
(74) *Attorney, Agent, or Firm*—Arthur E. Kluegel

(57) ABSTRACT

Disclosed is color silver halide photographic element comprising a light-sensitive silver halide emulsion layer or a non-silver containing light-insensitive layer, said light-sensitive or light-insensitive layer containing a polymer compound comprising a repeating benzotriazole subunit wherein a) the benzotriazole monomer corresponding to the benzotriazole subunit has a Calculated logP of at least 3.1 and less than 6.2; or b) the benzotriazole monomer corresponding to the benzotriazole subunit has a Calculated logP of less than 3.1 and the polymer additionally comprises a co-monomer with Calculated logP of 0.5 or greater, and the amount of the polymer compound in the element is sufficient to increase the photographic speed of the element compared to the same element without the polymer compound.

40 Claims, No Drawings

COLOR PHOTOGRAPHIC ELEMENT CONTAINING SPEED-IMPROVING BENZOTRIAZOLE POLYMER

FIELD OF THE INVENTION

This invention relates to a color photographic element comprising, in a layer containing a light-sensitive silver halide emulsion layer or in a non-silver containing light-insensitive layer, a speed-improving benzotriazole polymer with a certain minimum degree of hydrophobicity.

BACKGROUND OF THE INVENTION

It is a long-standing objective of color photographic origination materials to maximize the overall response to light while maintaining the lowest possible granularity. Increased photographic sensitivity to light (commonly referred to as photographic speed) allows for improved images captured under low light conditions or improved details in the shadowed regions of the image. In general, the overall light sensitivity provided by the light-sensitive silver halide emulsions in such systems is determined by the size of the emulsion grains. Larger emulsion grains capture more light. Upon development, the captured light is ultimately converted into dye deposits which constitute the reproduced image. However, the granularity exhibited by these dye deposits is directly proportional to the grain size of the silver halide emulsion. Thus, larger silver halide emulsion grains have higher sensitivity to light but also lead to higher granularity in the reproduced image. Therefore, it is a fundamental problem in photography to improve the light sensitivity of a silver halide element without a corresponding increase in another property such as granularity. In this description, it will be understood that the demonstrated increase in sensitivity is accomplished without a significant sacrifice in granularity. Stated from another perspective, it has been a long-standing problem to provide materials which maximize the response to light of a silver halide emulsion for any given grain size.

For example, it is well known that highly reactive couplers or couplers that form dyes with high extinction coefficients can maximize the response of silver halide emulsions. However, the increased amplification caused by these types of dye forming materials also directly leads to higher granularity.

It is highly desirable to provide non-imaging materials that lead to increased photographic speed without having to increase the size of the light-sensitive silver halide grains. Ideally, the addition of such materials should not require the use of permanent solvents (non-reactive, non-volatile organic liquids with low aqueous solubility) in order to be introduced or effective in a photographic film. The use of such permanent solvents is generally unfavorable because of cost, film thickness, increased total organic load and environmental factors.

U.S. Pat. No. 4,528,264 describes the use of polymeric benzotriazoles as antifoggants. However, the materials disclosed do not provide improved light sensitivity.

Pending application U.S. Ser. No. 09/358,057 (D78393) describes the use of certain polymeric heterocycles derived from a monomeric heterocycle, including benzotriazoles, with a ClogP of 6.2 or greater to increase the light sensitivity of a photographic element.

Pending application Ser. No. 09/540,808 (D80060) describes the use of certain polymeric heterocycles derived from either bicyclic monomers with a minimum of 3 heteroatoms of which no more than 2 heteroatoms can be connected in sequence and a ClogP less than 6.2 or monocyclic monomers with 3 heteroatoms and a ClogP of less than 8.75 to increase the light sensitivity of a photographic element.

U.S. Pat. Nos. 5,213,959 and 5,275,931 describe the use of heterocyclic antifoggants that have a reactive substituent that chemically reacts with the dispersing medium to form a covalent bond in a photographic element to prevent diffusion.

A problem to be solved is to provide color photographic elements that exhibit improved photographic speed and methods for processing such elements. In particular it is desirable to provide improved speed using polymeric benzotriazoles useful over a broader range of Calculated logP values than heretofore available.

SUMMARY OF THE INVENTION

The invention provides a color silver halide photographic element comprising a light-sensitive silver halide emulsion layer or a non-silver containing light-insensitive layer, said light-sensitive or light-insensitive layer containing a polymer compound comprising a repeating benzotriazole subunit wherein a) the benzotriazole monomer corresponding to the benzotriazole subunit has a Calculated logP of at least 3.1 and less than 6.2; or b) the benzotriazole monomer corresponding to the benzotriazole subunit has a Calculated logP of less than 3.1 and the polymer additionally comprises a co-monomer with Calculated logP of 0.5 or greater;

and the amount of the polymer compound in the element is sufficient to increase the photographic speed of the element compared to the same element without the polymer compound.

The invention provides color photographic elements that exhibit improved photographic speed and methods for processing such elements.

DETAILED DESCRIPTION OF THE INVENTION

The invention is generally as described above. In various aspects of the invention, the imaging layer that contains the polymer comprises an iodobromide emulsion, comprises a particular grain size, is an origination material, and is processed with a color developer such as a paraphenylene diamine developer. In other aspects of the invention, the polymer is located in a layer adjacent to an imaging layer.

The present invention relates to a light-sensitive color photographic element with at least one red sensitive silver halide emulsion layer with at least one non-diffusing cyan coupler, at least one green sensitive silver halide emulsion layer with at least one non-diffusing magenta coupler and at least one blue sensitive silver halide emulsion layer with at least one non-diffusing yellow coupler.

The feature of the polymeric materials of the invention that enables the desired increase in light sensitivity is a balance in the overall degree of hydrophobicity or water solubility. This can be achieved in two ways. The first to increase the hydrophobicity of the benzotriazole subunit by using the appropriate substituents such that the Calculated logP (as defined hereinafter) of the corresponding monomer is at least 3.1 but less than 6.2. Whenever the Calculated logP of the benzotriazole unit is at least 3.1, it is preferred that there is an additional co-monomer (not restricted to any particular range of Calculated logP) that contains an ionizable water-solubilizing group (hereinafter referred to as the ionizable monomer or IM) in order to achieve the best balance of overall hydrophobicity. If the Calculated logP of the benzotriazole monomer is less than 3.1, then it is also possible to increase the hydrophobicity of the polymer by the addition of a co-monomer that has a Calculated logP of at least 0.5 or greater (hereinafter referred to as high Calculated logP co-monomer or CM). It is also preferred that either the CM used with benzotriazoles with Calculated logP of less than 3.1 has an ionizable water solubilizing group or that a IM is additionally present.

It is desired that the compound of the invention should achieve an improvement in terms of photographic speed, compared to the same element without the compound, of at least 0.05, and desirably at least 0.10 and even 0.25 stops or more without causing a significant increase in granularity.

The polymeric materials of the invention, or "speed polymers," are polymers that contain a repeating benzotriazole unit. The polymeric backbone may be all carbon atoms (such as those derived from polymerization of olefinic materials) or may contain heteroatoms including nitrogen or oxygen atoms (such as polyesters, polyethers, polyureas, polycarbonates or polyamides produced by condensation or ring opening reactions, etc.). Preferred units are defined by the following general formula (A), whose corresponding monomer, defined by the following general formula (A') meets the Calculated logP requirements:

(A)

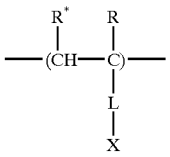

(A')

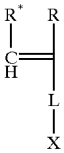

where R is hydrogen, cyano, carbonyl, alkyl or aryl group, R* is hydrogen, carbonyl, alkyl or aryl and may be connected with R to form a ring system, L is a linking group and X is a benzotriazole group. Similar compounds are known to cause inhibition of silver development and antifogging behavior, but because of the increased hydrophobicity due to the polymer backbone, they do not cause inhibition of silver development in elements of the invention.

Typically, R is hydrogen, carbonyl or an alkyl group, preferably having 1 to 6 carbon atoms. Examples of suitable alkyl groups are methyl, ethyl and butyl. Monomers in which R is hydrogen or a methyl group are especially preferred. R* is preferably a hydrogen, alkyl or a carbonyl group connected with R when R is a carbonyl group.

L is a divalent linking group that permanently attaches X to the polymeric backbone and preferably, contains 1 to 20 carbon atoms. Preferred linking groups are represented by Formulas L-1 and L-2:

(L-1)

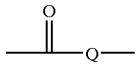

(L-2)

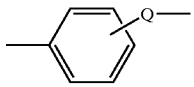

where Q is an oxygen atom, a sulfur atom, a nitrogen atom, a methylene group or a carbonyl group. Examples of particularly preferred linking groups according to Formula L-1 are —CONH— and —$CO_2$—. Examples of particularly preferred linking groups according to Formula L-2 are where Q is —O—, —S—, —NH—, —CO—, —$CH_2$— or —$SO_2$—. There may be optional groups or atoms, such as alkylene groups, that attach Q to X. Some examples of these extended linking groups would be —$CONHCH_2CH_2CONH$—X, —$CO_2CH_2CH_2$—X, —$CONHCH_2CH_2$—O—$CH_2CH_2NHCO$—X, where X is as defined below.

X is a benzotriazole group with a N—H bond as part of the triazole as shown by Formula (b1) for —L—X:

(b1)

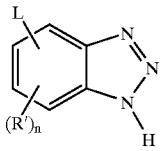

where L is part of the linking group defined above, R' is an optional substituent and n is 0–3. The substituents located directly on the benzotriazole subunits of the invention can be hydrogen or any group chosen such that together the entire compound meets the overall Calculated logP requirement and in addition, provide a covalent link to the polymeric backbone. These substituents may be vinyl, acetylenic, alkyl, aryl, alkoxy or aryloxy, alkylthio or arylthio, sulfoxyl, sulfonyl, sulfamoyl

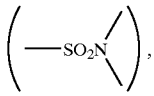

halo such as fluoro, chloro, bromo or iodo, cyano, nitro, —O—CO—, —O—$SO_2$—, a heterocyclic group such as furanyl or morpholino, a carbonyl group such as keto, carboxylic acid (—$CO_2H$), carboxylate ester (—$CO_2$—) or carbamoyl

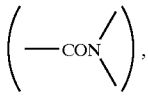

or an amino group such as a primary, secondary or tertiary substituted nitrogen, carbonamido (>NCO—) or sulfonamido (>$NSO_2$—), hydroxyl or thiol. It should be noted wherever it is possible to write alternative tautomeric structures of the heterocyclic nucleus, these are considered to be chemically equivalent and are part of the invention. In particular, non-tertiary amino groups (—$NH_2$ or —NH—) can attached to a ring atom such that conjugation to a ring nitrogen can occur to provide tautomeric forms of the heterocycle. The benzotriazole must have a free N—H bond during development and cannot be attached to the polymeric backbone through the nitrogen of the triazole ring. However, the N—H bond of the benzotriazole may be replaced by a temporary blocking group that is removed in a non-imagewise fashion during development.

Preferred forms of the benzotriazole monomers are according to Formula (b2) wherein Q is part of the linking group L as defined above. The most preferred examples of a benzotriazole derivative are where Q is an —O—, —S—, —NH—, —CO—, —$CH_2$— or —$SO_2$— group.

(b2)

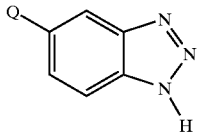

Generally, the appropriately substituted heterocycle serves as a monomer or a co-monomer for the preparation of the speed polymer, although it is possible to pre-form the polymer backbone and then attach the heterocycle.

Optionally, there may be other repeating heterocyclic or non-heterocyclic units present in the polymeric backbone. The polymers may also contain two or more different types of these heterocycles. Formulations useful for the purpose of the invention, namely an increase in photographic speed, have the desired overall hydrophobicity and do not cause inhibition of silver development. The hydrophobicity of the speed polymer is governed both by the nature of the polymeric backbone and by the hydrophobicity of the monomeric benzotriazole unit (as measured by Calculated logP).

The benzotriazole fragments in the polymers of the invention are not couplers and do not react with oxidized developer (Dox) to generate dyes or any other product. The benzotriazoles are stable to other components of the processing solutions and do not contain substituents that undergo substantial amounts of chemical reaction in any of the processing solutions (except when the NH bond of the benzotriazole is replaced by a temporary blocking group that is removed in a non-imagewise fashion as detailed below). For example, the benzotriazole fragments do not contain hydrazino or hydroquinone substituents that may cross-oxidize during silver development. However, the benzotriazole fragments may contain, for example, ester substituents that are not substantially hydrolyzed (less than 5–10%) during the development process.

It is desired that the polymeric backbone of the materials of the invention does not undergo any significant amounts (less than 5–10%) of chemical or redox reaction directly with oxidized color developer or other components of the processing solutions. The heterocyclic fragments are permanently bonded to the polymeric backbone and are not released from the polymeric backbone during processing. The polymers are colorless as coated. However, the polymeric backbone may contain other pendant groups in addition to the heterocyclic fragments that do react with Dox to form colored dyes or release photographically useful groups (PUGs) in an imagewise fashion. Examples would be polymers with the appropriate heterocyclic fragments that additionally contain coupling species such as pyrazolones or napthols independently attached to the polymer backbone. The polymeric compounds of the invention are located in the film element as described and are not added to the processing solutions.

An important feature of the polymers of the invention is their hydrophobicity which is partially related to their octanol/water partition coefficient (logP) of the benzotriazole monomer or other monomers from which the polymer is formed. If the partitioning into water of the benzotriazole heterocyclic fragment is too high, then silver inhibition occurs. However, by attaching a benzotriazole fragment with the appropriate degree of inherent hydrophobicity (as measured by Calculated logP) to a polymeric backbone or by modifying the hydrophobicity of the backbone (by the absence or relative amounts of CM and/or IM) itself, then significant amounts of silver inhibition and antifogging are prevented and the photographic speed effect is maximized.

Because it can be difficult to measure logP values above 3, a model can be used to compute an estimate of logP, called Calculated logP, that defines the limits of the monomers used in the invention. For the purposes of this invention, Calculated logP are calculated using KowWin version 1.66 or later versions of the software, available from Syracuse Research Corporation, Syracuse, N.Y. (esc.syrres.com). If this software is unavailable, the applicant will furnish the Calculated logP values for any specific materials.

The way to enter a structure into the KowWin program in order to calculate a logP is through a SMILES string. An example is C=Cc3ccc(CSCC(=O)Nc1ccc2NN=Nc2c1)cc3 for the benzotriazole monomer B1-1. This entry gives the value 3.62 in KowWin. KowWin also has the ability to improve modeling of unknown structures by adding experimental data related to a structurally related material.

Some structures can be drawn in multiple tautomeric forms. For the purposes of the invention, the Calculated logP is to be computed for the tautomer whose heterocyclic nucleus experimentally predominates in an aqueous fluid environment at room temperature. Moreover, for the purposes of this invention, the Calculated logP refers to neutral monomeric molecules, even if they would be ionized or protonated (either fully or in part) at the processing pH or at the ambient pH of the photographic film. In the case of benzotriazole monomers in which the N—H is temporarily blocked with a removable group, Calculated logP should be calculated based on the monomer with the free N—H bond. In addition, in the case where the polymer is not directly formed from a heterocyclic monomer but is prepared by reacting a pre-formed polymer with the appropriate benzotriazole nucleus, the Calculated logP should be calculated on the basis of the entire monomeric heterocylic subunit (as in general Formula (A') including any linking groups and that part of the polymer which would been part of the corresponding monomeric species.

One of the most important and novel characteristics of the polymers of this invention is the finely tuned balance between their hydrophobic and hydrophilic nature. As mentioned earlier, the hydrophobic/hydrophilic nature of a compound can be estimated by calculation of its partition coefficient between octanol and water (Calculated logP) using the KowWin program, and this has been used herein to define the range of values of Calculated logP for each class of monomer within which they exhibit the desired effect when included as part of a polymer. The Calculated logP limitations apply only to the monomeric fragments and not the overall polymer whose hydrophobicity can be controlled separately. The terms 'ballast' or 'ballasted' as generally applied in the photographic art are often applied only loosely and without quantification to imply a restriction of movement. The activities of the monomeric fragments are therefore best defined in terms of their Calculated logP values.

For each compound of the invention, as the laydown is increased a threshold level is reached following which the speed improvement gradually increases with laydown, after which the improvement then levels off at a compound specific maximum level. It will be appreciated that the amount is also a function of other variables such as the location and number of layers in which the compound is located, the solvent used, and film dimensions. Thus, it is desirable to have enough laydown of the compound in order to obtain the speed improvement. Suitably, there is present sufficient laydown to achieve an improvement of at least 0.05, and desirably at least 0.10 and even 0.25 stops or more. Where the polymer is present in a sensitized layer, the ratio of polymer to silver is suitably at least 0.1 mmol of heterocyclic compound in the polymer per mol of silver and, more preferably, at least 1.0 mmol of heterocyclic compound in the polymer per mol of silver and, most preferably, at least 2.0 mmol per mol of silver. When coated in a non-silver containing layer, the laydown of the heterocyclic compound in the polymer is suitably at least $3\times10^{-5}$ mol/m$^2$ or greater, or more preferably, at least 0.0001 mol/m$^2$ or greater.

The following are examples of monomeric benzotriazoles compounds of Calculated logP of at least 3.1 but less than 6.2 (designated as benzotriazole series B1), along with the corresponding Calculated logP values, that are useful as part of a polymer in this invention:

B1-1: (3.62)

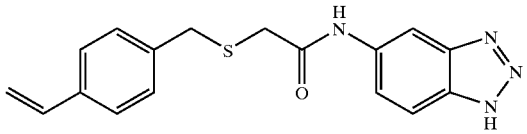

B1-2: (3.46)

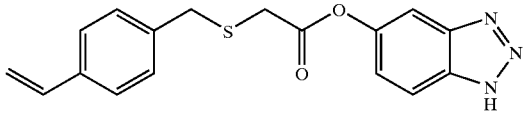

B1-3: (3.70)

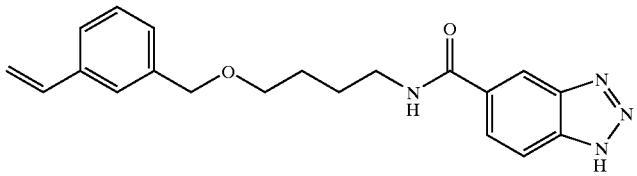

B1-4: (4.01)

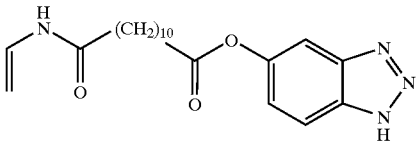

B1-5: (4.38)

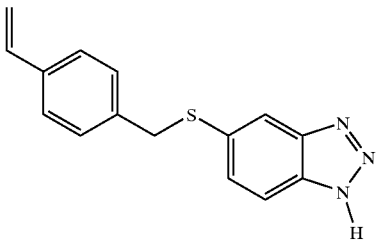

B1-6: (5.14)

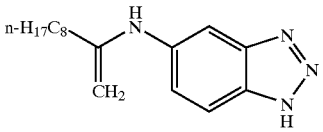

B1-7: (3.31)

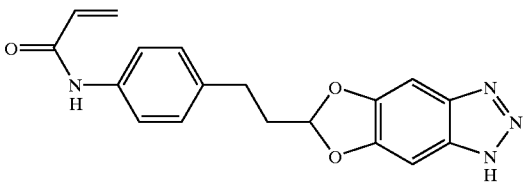

-continued
B1-8: (3.43)
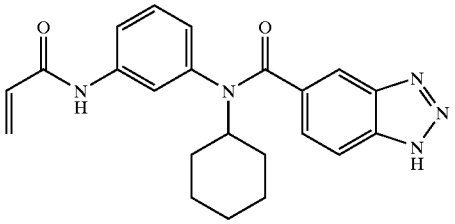
B1-9: (4.07)
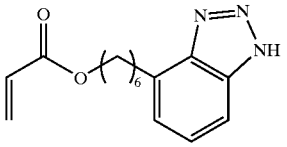
B1-10: (4.12)
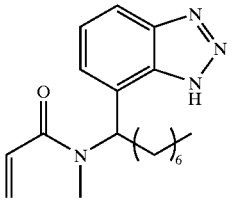
B1-11: (3.61)
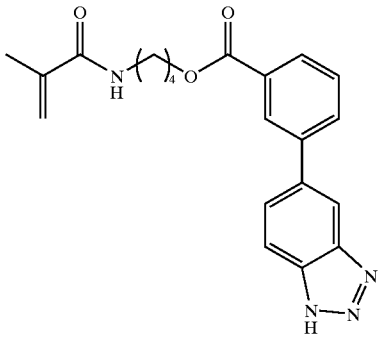
B1-12: (6.15)
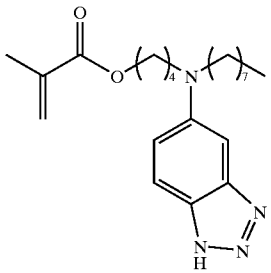
B1-13: (4.95)
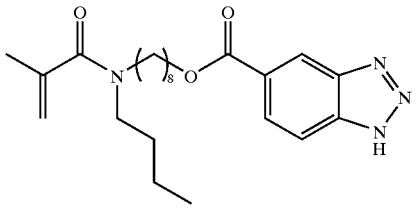

-continued
B1-14: (3.40)
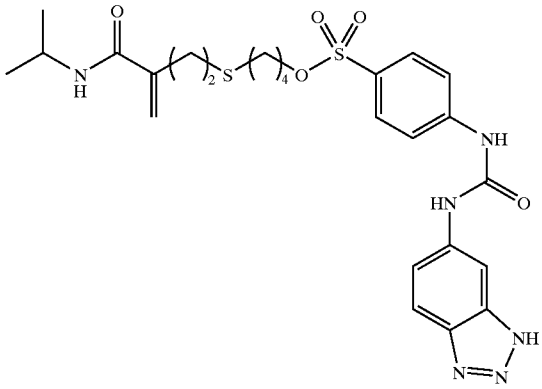
B1-15: (3.47)
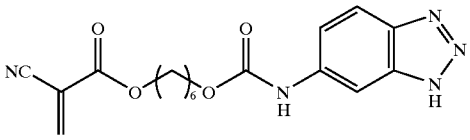
B1-16: (3.82)
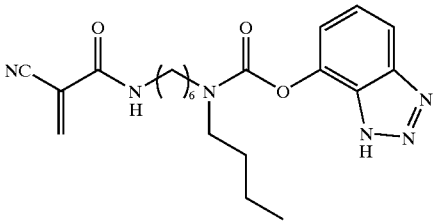
B1-17: (4.46)
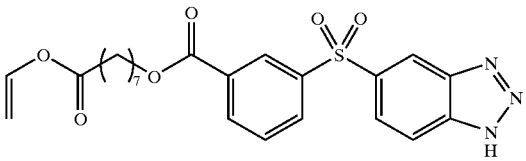
B1-18: (3.79)
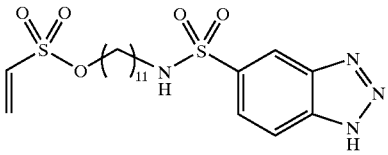
B1-19: (4.94)
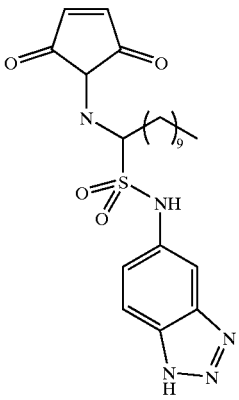

-continued
B1-20: (3.75)
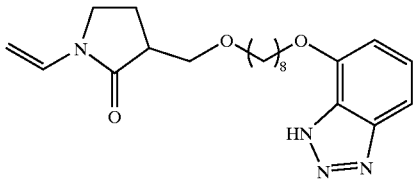
B1-21: (3.62)
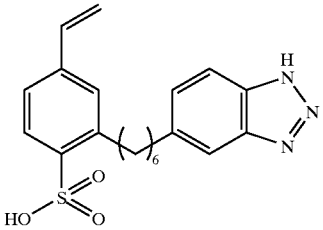
B1-22: (4.59)
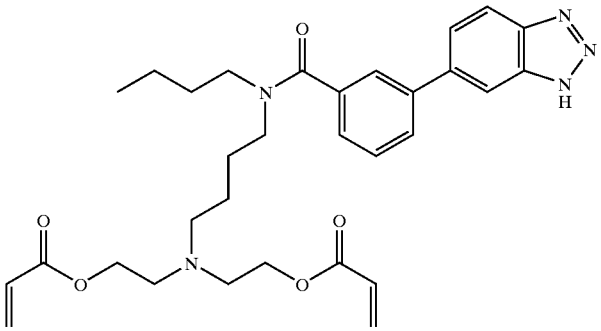
B1-23: (6.00)
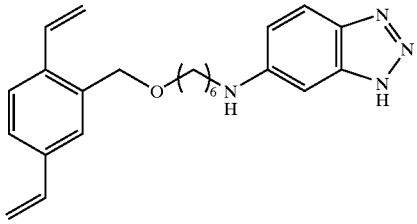
B1-24: (3.58)
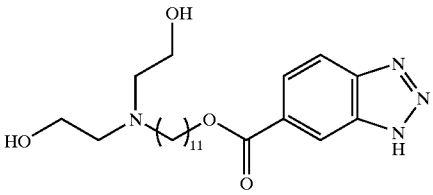
B1-25: (4.60)
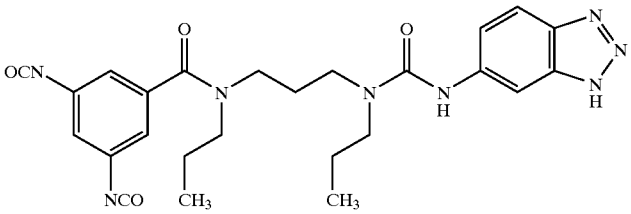

-continued

B1-26: (3.98)

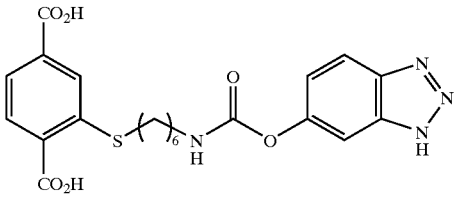

B1-27: (4.45)

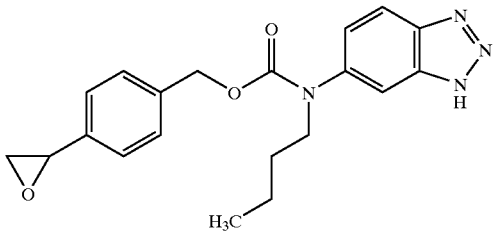

To adjust the water solubility and hydrophobicity of the polymers which contain a benzotriazole subunit with a Calculated logP of at least 3.1 and less than 6.2, an ionizable monomer (IM) is preferred. It is preferred that ionizable monomers contains an ionizable functional group selected from the group consisting of sulfonates, sulfates, phosphates, and carboxylic acids, with sulfonates and sulfates being particularly preferred. The Calculated logP of these preferred IM monomers is not limited to any particular range. They can be represented by the following general formula (IM) and its corresponding monomer by (IM'):

(IM)

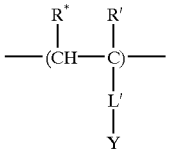

(IM')

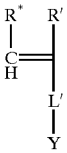

where R' is hydrogen, carbonyl, alkyl or aryl group, R* is hydrogen, or an alkyl or carbonyl group and may be connected with R' to form a ring system, L' is a linking group as defined before (as L) and Y is an ionizable subunit such as a sulfonate, sulfate, phosphate, carboxylate, thiosulfate or sulfinate, with sulfonate and sulfate being particularly preferred. Suitable ionic monomers include acrylic acid, its salts and its derivatives such as alpha-chloroacrylic acid and alpha-alkylacrylic acid (such as methacrylic acid, etc.) or other vinylogous acids such as itaconic acid, citraconic acid or crotonic acid, as well as, but not limited to, the following:

IM'-1:

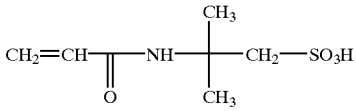

IM'-2:

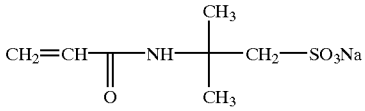

IM'-3:

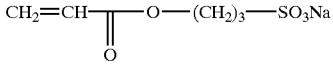

IM'-4:

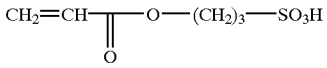

IM'-5:

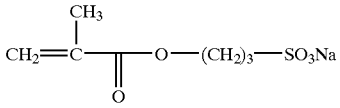

IM'-6: $CH_2{=}CH{-}SO_3Na$

IM'-7:

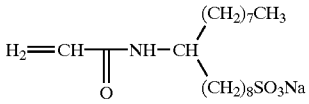

IM'-8:

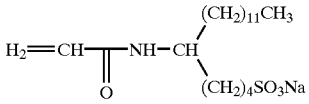

IM'-9:

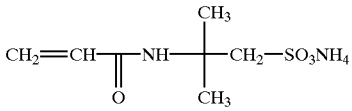

IM'-10:

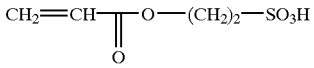

-continued

IM'-11: $CH_2{=}CH{-}C(=O){-}O{-}(CH_2)_2{-}SO_3Na$

IM'-12: $CH_2{=}CH{-}C_6H_4{-}SO_3Na$

IM'-13: $CH_2{=}CH{-}C_6H_4{-}SO_2Na$

IM'-14: $CH_2{=}CH{-}C_6H_4{-}SO_3H.$

IM'-15: $CH_2{=}CH{-}C_6H_4{-}SO_2K$

IM'-16: $CH_2{=}CH{-}CH_2{-}O{-}CO{-}CH(C_{14}H_{29}){-}SO_3Na$

IM'-17: $CH_2{=}CH{-}C(=O){-}O{-}(CH_2)_3{-}SO_3Na$

The following are examples of monomeric benzotriazoles compounds of Calculated logP of less than 3.1 (designated as benzotriazole series B2), along with the corresponding Calculated logP values, that are useful as part of a polymer in this invention when used in combination with monomers of Formula (CM'):

B2-1: (0.63)

B2-2: (1.39)

B2-3: (1.94)

-continued

B2-4: (2.99)

B2-5: (0.38)

B2-6: (2.99)

B2-7: (−0.08)

B2-8: (1.21)

B2-9: (1.94 as N—H)

B2-10: (1.18)

B2-11: (−0.41)

B2-12: (1.12)

To adjust the water solubility and hydrophobicity of the polymers which contain a benzotriazole subunit with a Calculated logP of less than 3.1 and obtain the object of the invention, it is required to have an additional repeating unit (CM) present whose corresponding co-monomer (CM') has a Calculated logP of at least 0.5 or greater. The repeating sub-unit with Calculated logP of at least 0.5 has a structure according to Formula (CM) and the corresponding monomer by Formula (CM'):

(CM)

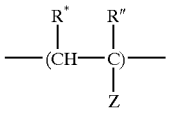

(CM')

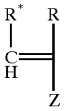

where R' is hydrogen, cyano, alkyl or aryl group, R* is hydrogen, or an alkyl or carbonyl group and may be connected with R' to form a ring system, and Z is an aryl group, an oxygen atom, a nitrogen atom or a carbonyl group substituted so that the entire monomer meets the Calculated logP requirements. For each class of co-monomer, there may be a different preferred minimum Calculated logP and a different preferred ratio of benzotriazole to co-monomer.

Some examples of co-monomers of the CM' type where Z is an aryl group are styrene (Calculated logP 2.89), alpha-methylstyrene (Calculated logP=3.44), vinyltoluene (Calculated logP=3.44), chloromethylstyrene (Calculated logP=3.70) or 2-vinylpyridine (Calculated logP=1.71). However, when Z is an aryl group, it is preferred that the Calculated logP of the co-monomer is 3.75 or greater or more preferably, 4.5 or greater. Examples of preferred co-monomers of the CM' type where Z is an aryl group would be p-t-butylstyrene (Calculated logP=4.80), p-(1-napthoyl)methylstyrene (Calculated logP=5.86), p-decylstyrene (Calculated logP=7.86), p-n-octylstyrene (Calculated logP=6.88), (p-t-butylphenoxyl)methylstyrene (Calculated logP=6.59), (p-t-octylphenoxyl)styrene (Calculated logP=8.45), n-octadecyloxymethylstyrene (Calculated logP=11.03). It is preferred that the co-monomers where Z is an aryl group is least 1% by weight of the total amount of polymer and more preferably, at least 5% by weight. Styrene sulfonic acid or its salts (IM'-12; Calculated logP=−0.26) are not suitable for use in combination with benzotriazole monomers with Calculated logP of less than 3.1 for the purposes of this invention, although it may be present if used in combination with a co-monomer that meets the Calculated logP requirement.

An example of a co-monomer of the CM' type where Z is an oxygen atom is vinyl acetate (Calculated logP=0.73). However, when Z is an oxygen atom, it is preferred that the Calculated logP of the co-monomer is 1.00 or greater or more preferably, 3.2 or greater or most preferably, 3.75 or greater. Examples of preferred co-monomers of the CM' type where A is an oxygen atom would be vinyl hexylate (Calculated logP=2.69), vinyl 2-ethylhexylate (Calculated logP=3.60), vinyl octylate (Calculated logP=4.17), vinyl laurate (Calculated logP=6.62) and vinyl octadecylate (Calculated logP=8.59). It is preferred that the co-monomers where Z is an oxygen atom is least 1% by weight of the total amount of polymer and more preferably, at least 5% by weight.

When Z is a nitrogen atom, it is preferred that the Calculated logP of the co-monomer is 1.00 or greater or more preferably, 3.2 or greater or most preferably, 3.75 or greater. Examples of co-monomers of the CM' type where A is a nitrogen atom would be N-vinylcaprolactam (Calculated logP=1.23) or N-ethyl-N-vinylbenzamide (Calculated logP=2.07). It is preferred that the co-monomers where Z is a nitrogen atom is least 1% by weight of the total amount of polymer and more preferably, at least 5% by weight. N-vinylpyrrolidone (Calculated logP=0.25) is not suitable for use in combination with benzotriazole monomers with Calculated logP of less than 3.1 for the purposes of this invention, although it may be present if used in combination with a co-monomer that meets the Calculated logP requirement.

Examples of co-monomers of the CM' type where Z is a carbonyl group are according to Formula (CM'-a):

(CM'-a)

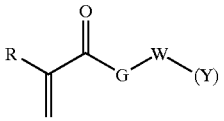

where R is hydrogen or methyl, G is an oxygen or nitrogen atom, W is an alkyl or aryl group and Y is an optional ionizable water-solubilizing group as defined before.

Some examples of comomoners of the CM'-a type where G is an oxygen atom are n-butyl methacrylate (Calculated logP=1.68), benzyl methacrylate (Calculated logP=1.91) and n-hexyl acrylate (Calculated logP=3.18). However, when G is an oxygen, it is preferred that the Calculated logP of the acrylate ester monomer be 3.2 or greater, or more preferably, 3.75 or greater. Neither acrylic acid or its salts (Calculated logP=0.44) or 2-hydroxyethyl acrylate (Calculated logP=−0.25) are suitable for use in combination with benzotriazole monomers with Calculated logP of less than 3.1 for the purposes of this invention, although they may be present if used in combination with a co-monomer that meets the Calculated logP requirement. When G is a nitrogen, it is preferred than the Calculated logP of the acrylamide monomer be at least 2.2 or greater or more preferably, 3.2 or greater or most preferably, 3.75 or greater. Suitable monomers of Formula (CM'-a) where G is a nitrogen atom are, but not limited to, the following (corresponding Calculated logP in parenthesis):

| | |
|---|---|
| CM'-a-1 (2.42): | N-cycloheptylacrylamide |
| CM'-a-2 (3.10): | N-octylacrylamide |
| CM'-a-3 (2.91): | N-cyclooctylacrylamide |
| CM'-a-4 (3.02): | N-(2-ethylhexyl)acrylamide |
| CM'-a-5 (3.18): | 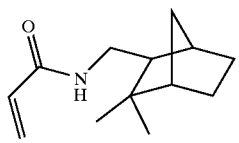 |
| CM'-a-6 (4.08): | N-decylacrylamide |
| CM'-a-7 (3.97): | N-(2,2-dimethyloctyl)acrylamide |

-continued

CM'-a-8 (3.33):

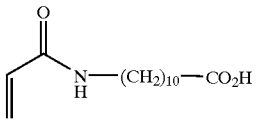

CM'-a-9 (2.73): N-adamantylacrylamide
CM'-a-10 (5.06): N-dodecylacrylamide
CM'-a-11 (7.03): N-hexadecylacrylamide
CM'-a-12 (8.01): N-octadecylacrylamide CM'-a-13 (6.70):

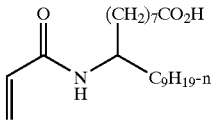

CM'-a-14 (3.10):

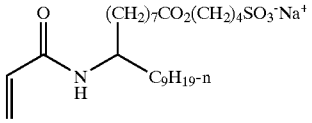

CM'-a-15 (3.64): N-octylmethacrylamide
CM'-a-15 (4.51): N-(2,2-dimethyloctyl)methacrylamide CM'-a-16 (3.88):

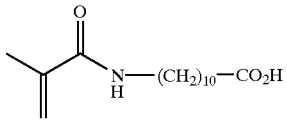

CM'-a-17 (5.61): N-dodecylmethacrylamide
CM'-a-18 (8.55): N-octadecylmethacrylamide CM'-a-19 (1.34):

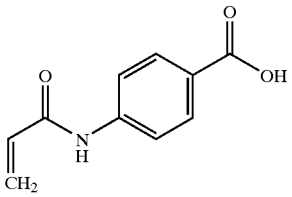

Acrylamide (Calculated logP=−0.81), methacrylamide (Calculated logP=−0.26) and sodium 2-acrylamide-2-methylpropanesulfonate (IM'-1; Calculated logP=−2.19) are not suitable for use in combination with benzotriazoles with Calculated logP of less than 3.1 for the purposes of this invention, although they may be present if used in combination with a co-monomer that meets the Calculated logP requirement.

Preferred co-monomers according to Formula (CM') are where Z is a carbonyl group. It is also preferred that either the co-monomer according to Formula (CM') contains an ionizable water-solubilizing group or (more preferably) used in combination with a third monomer (IM) that contains an ionizable water-solubilizing group such as those according to Formula (IM'). It is preferred that the co-monomers where Z is a carbonyl group is more than 5% by weight of the total amount of polymer and more preferably, at least 10% by weight.

Optionally, an additional monomer can be used to additionally adjust the hydrophobicity and Glass Transition Temperature (Tg) of the polymers containing either series B1 or B2 of benzotriazole subunit. The Calculated logP of these monomers are not critical and not limited to any particular range. Monomers suitable for this application include an ester or amide derived from an acrylic acid or one of its derivatives (for example, acrylamide, methacrylamide, n-butylacrylamide, t-butylacrylamide, diacetone acrylamide, methyl acrylate, ethyl acrylate, 2-hydroxyethyl acrylate, n-propyl acrylate, n-butyl acrylate, t-butyl acrylate, isobutyl acrylate, 2-ethylhexyl acrylate, tetrahydrofuryl acrylate, methyl methacrylate, ethyl methacrylate, n-butyl methacrylate, benzyl methacrylate, tetrahydrofuryl methacrylate, etc.), a vinyl ester (for example, vinyl acetate, vinyl propionate, vinyl laurate, etc.), acrylonitrile, methacrylonitrile, an aromatic vinyl compound (for example, styrene or a derivative thereof, vinyl toluene, divinyl benzene, vinyl acetophenone, etc.), vinylidene chloride, a vinyl alkyl ether (for example, vinyl ethyl ether, etc.), an ester of maleic acid, N-vinyl-2-pyrrolidone, N-vinylpyridine, 2- or 4-vinylpyridine, etc. Of these monomers, an ester of acrylic acid, an ester of methacrylic acid, and styrene and styrene derivatives are particularly preferred. Two or more ethylenic unsaturated monomers can be used together. For example, a combination of methyl acrylate and butyl acrylate, ethyl acrylate and styrene, tetrahydrofuryl methacrylate and ethyl acrylate, methyl acrylate and ethyl acrylate, etc., can be used.

When more than two monomers are present in the speed polymer, the weight percent of the benzotriazole monomer (such as defined by Formula (A') is suitably from 5 to 90% and preferably from 10 to 50%. The weight percent of monomers as defined by Formulas (IM') or (CM') is suitably from 1 to 90% and preferably from 5 to 80% and most preferably, from 10 to 60%. The weight percent of a third monomer not defined by the benzotriazole monomer or Formulas (IM') or (CM') can be from 10 to 60% and preferably from 10 to 30%.

The polymers of this invention can be prepared by solution polymerization techniques. Solution polymerization is well known in the art and can be found, for example, in "High Polymers, Vol. X, Polymer Processes", Calvin E. Schildknecht, Ed., Interscience Publishers, Inc. New York (1956), pp.175–194. Examples of the chemical initiators which may be used include a thermally decomposable initiator, for example, a persulfate (such as ammonium persulfate, potassium persulfate, sodium persulfate), hydrogen peroxide, 4,4'-azobis(4-cyanovaleric acid), 2,2'-azobis (2-methyl-N-(2-hydroxyethyl)propionamide),2,2'-azobis-(2-amidinopropane)dihydrochloride, 2,2'-azobis(N,N'-dimethyleneisobutylramidine), and redox initiators such as hydrogen peroxide-iron(II) salt, potassium persulfate-sodium hydrogensulfate, potassium persulfate-sodium metabisulfite, potassium persulfate-sodium hydrogen bisulfite, cerium salt-alcohol, etc. Suitable solvents for the polymerization include water, methanol, ethanol, propanol, isopropanol, DMF, DMSO, N-methyl pyrrolidone, N,N-dimethylacetamide, ethyleneglycol, diethyleglycol, triethyleneglycol, etc. Two or more solvents can be used together such as methanol/water, and DMF/water, etc.

The solubility of the polymer in water is suitably from 0.5% to 50% by weight (25° C.) and preferably from 2.5% to 50%. The architecture of the polymeric heterocycles can be random, alternate, block, graft, star or dentritric polymers. The molecular weight of the polymeric heterocycles is suitably from 1000 to 1,000,000 and preferably from 3000 to 50,000. Tg of the polymeric heterocycles is suitably from −40° C. to 250° C. and preferably from 0 to 200° C.

Some examples of the polymeric benzotriazoles that are derived from a benzotriazole monomer with a Calculated logP of 3.1 or greater and less than 6.2 of the invention are:

P-1: a polymer prepared from 12% B2-1, 71% acrylamide, 5% IM'-2 and 12% CM'-a-6

P-2: a polymer prepared from 11.3% B2-1, 83.3% acrylamide and 5.4% CM'-a-19

P-3: a polymer prepared from 40% B1-1 and 60% IM'-12

P-4: a polymer prepared from 20% B1-1 and 80% IM'-12

P-5: a polymer prepared from 40% B1-1, 50% acrylamide and 10% IM'-1

P-6: a polymer prepared from 25% B1-3, 25% IM'-12 and 50% acrylamide

P-7: a polymer prepared from 10% B1-5, 10% methacrylamide and 80% IM'-12

P-8: a polymer prepared from 20% B1-1, 10% styrene, 10% IM'-1 and 60% acrylamide P-9: a polymer prepared from 15% B2-1, 15% p-t-butylstyrene, 20% acrylamide and 50% IM'-12

P-10: a polymer prepared from 15% B2-1, 15% N-vinylcaprolactam, 20% acrylamide and 50% IM'-12

P-11: a polymer prepared from 15% B2-1, 15% vinyl octylate, 20% acrylamide and 50% IM'-12

P-11: a polymer prepared from 15% B2-1, 15% n-octyl acrylate, 20% acrylamide 50% IM'-12

P-12: a polymer prepared from 15% B2-1, 15% CM-a-8, 20% acrylamide and 50% IM'-12

P-12: a polymer prepared from 15% B2-10, 10% CM'-a-16 and 75% IM'-5

The materials of the invention can be added to a mixture containing silver halide before coating or, more suitably, be mixed with the silver halide just prior to or during coating. In either case, additional components like couplers, doctors, surfactants, hardeners and other materials that are typically present in such solutions may also be present at the same time. The materials of the invention may be added directly if water soluble, dissolved in an organic water miscible solution such as methanol, acetone or the like or added as a latex or suspension. In addition, one or more permanent solvents can be added to the polymer. However, it is desirable to provide these color photographic elements with no or minimal increase in the levels of permanent solvents. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Permanent solvents can also be described in terms of physical constants such as alpha, beta and pi* as defined by M. J. Kamlet, J-L. M. Abboud, M. H. Abraham and R. W. Taft, J. Org Chem, 48, 2877(1983). The preferred permanent solvents used in conjunction with the materials of the invention are those with Calculated logP of 5.0 or greater and beta values of 0.4 or greater or more preferably, beta values of 0.5 or greater. Preferred classes of solvents are carbonamides, phosphates, alcohols and esters. When a solvent is present, it is preferred that the weight ratio of compound to solvent be at least 1 to 0.1, or most preferably, at least 1 to 0.5. The materials of the invention may also be dispersed as an admixture with another component of the system such as a coupler or an oxidized developer scavenger so that both are present in the same oil droplet.

The sensitivity of the human eye is greatest to green light and so, the polymers of the invention are most useful when located in or adjacent to the green record (the layer whose maximum spectral sensitivity to light falls between 500 and 600 nm). The following magenta couplers are particularly beneficial when used in conjunction with the polymeric heterocycles of the invention:

M-1:

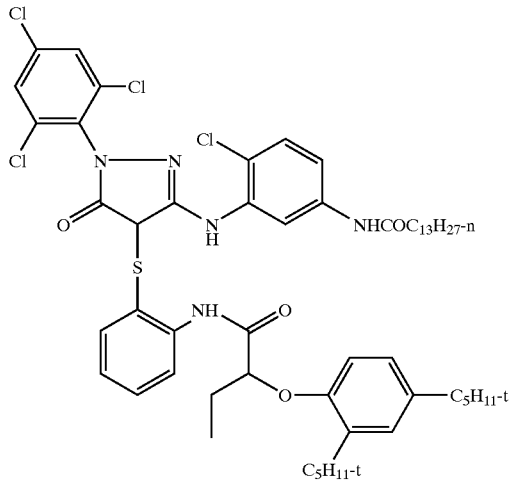

M-2:

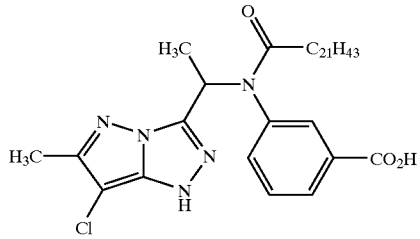

M-3:

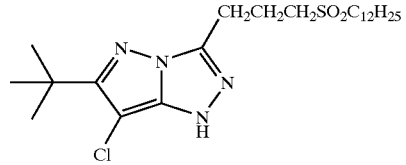

M-4:

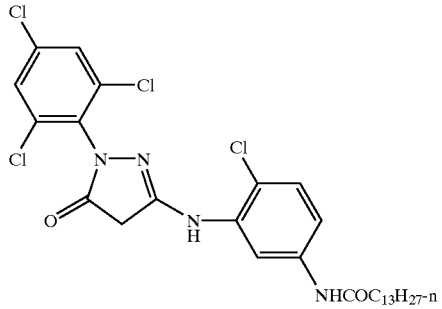

M-5:

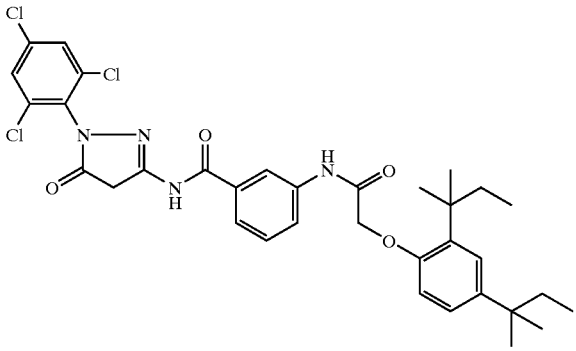

-continued
M-6:
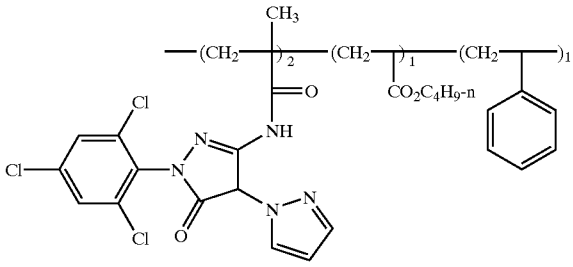
(by weight)
M-7:
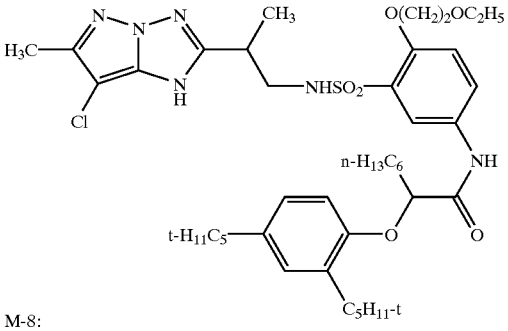
M-8:
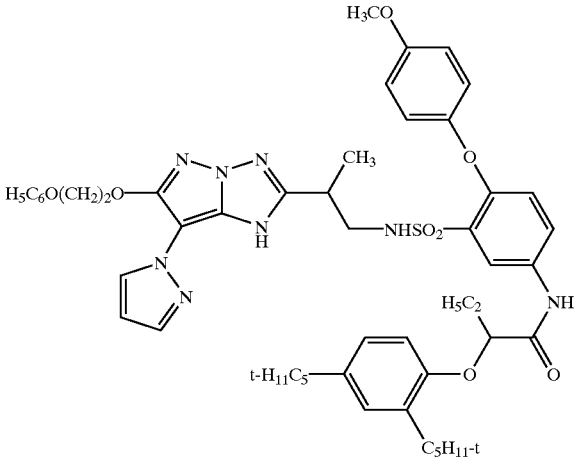
M-9:
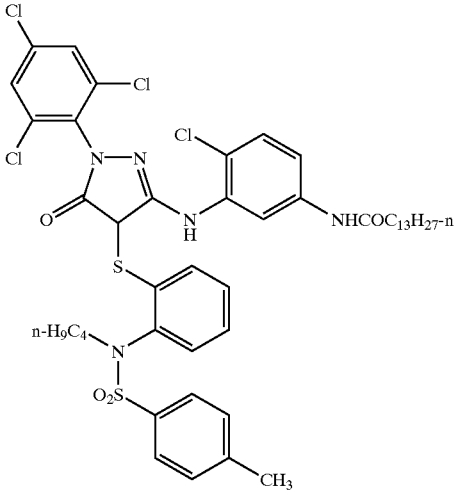
-continued
M-10:
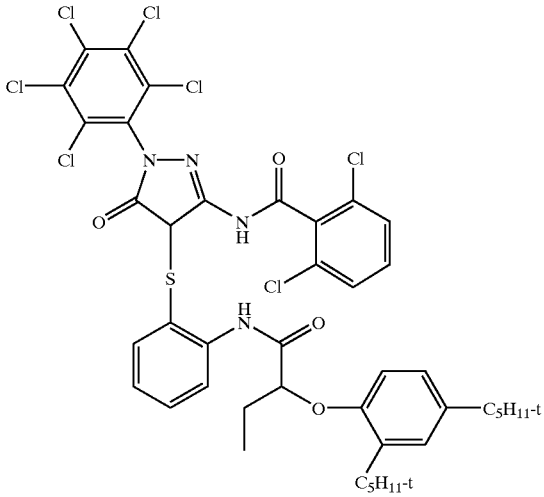
M-11:
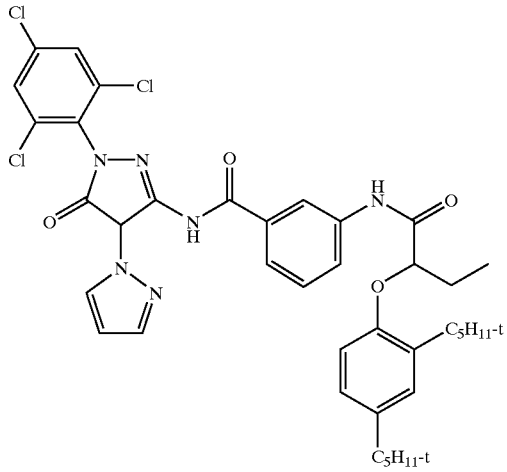
M-12:
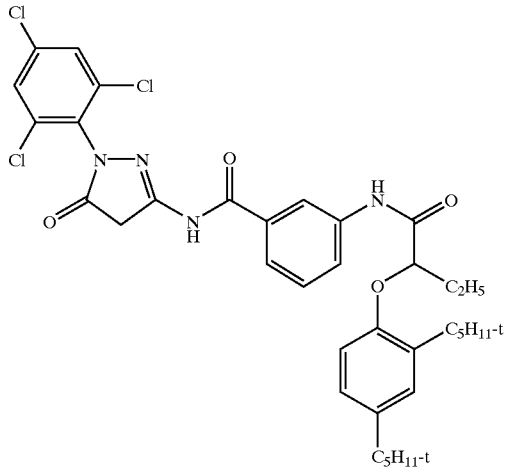
The following green sensitizing dyes are also particularly beneficial when used in combination with the polymeric heterocycles of the invention:

GSD-1:

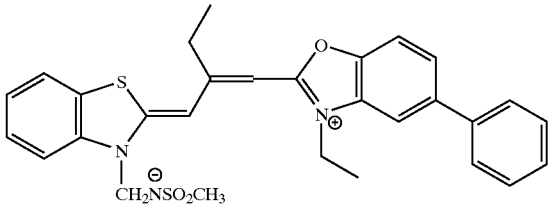

GSD-2:

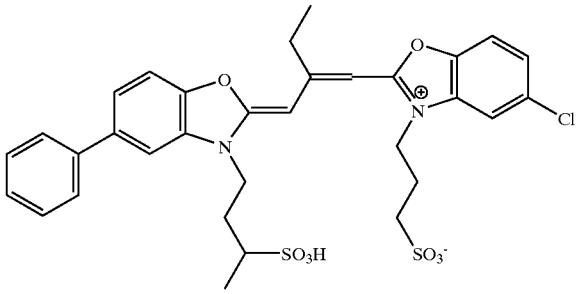

GSD-3:

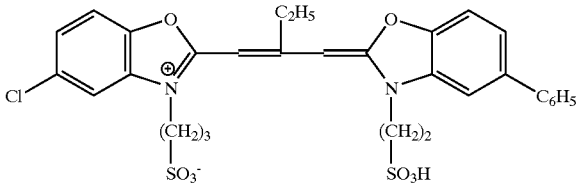

GSD-4:

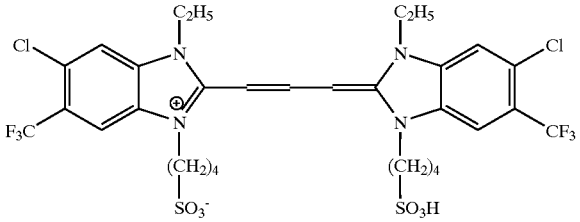

GSD-5:

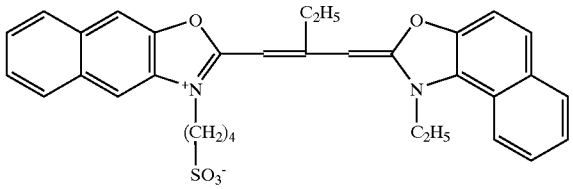

GSD-6:

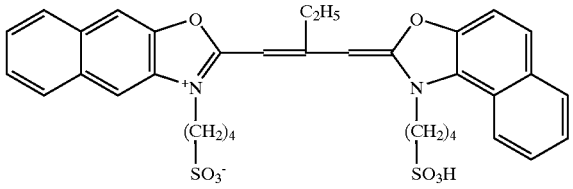

-continued

GSD-7:

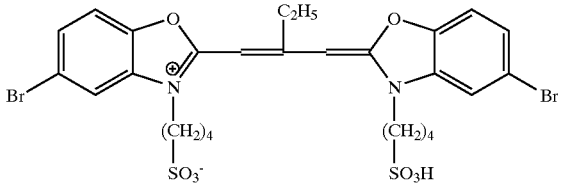

GSD-8:

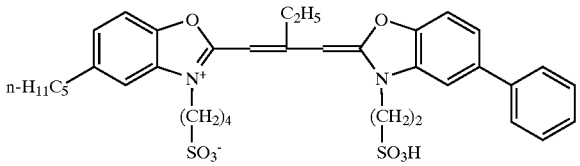

GSD-9:

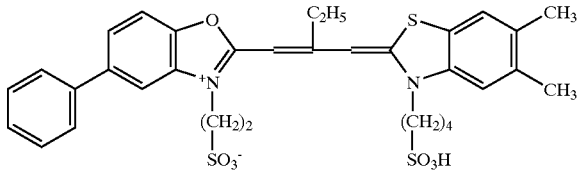

GSD-10:

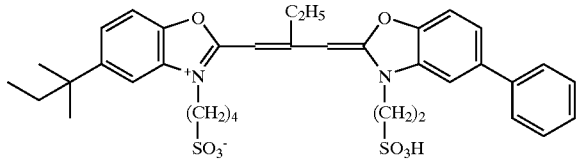

GSD-11:

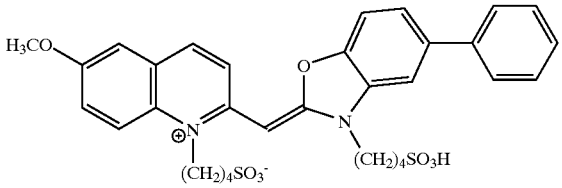

The type of light-sensitive silver halide emulsion used in the layer that contains the polymer of the invention may be important to obtain the desired increase in light sensitivity. The silver halide emulsion is suitably a silver iodobromide emulsion, meaning an emulsion that is low in chloride. By low in chloride, it is meant that there should be no more than 20 mol %. More suitably, there is present in the layer no more than 10 mol % chloride, and typically no more than 1 mol % chloride. The emulsion suitably contains at least 0.01 mol % iodide, or more preferably, at least 0.5 mol % iodide or most preferably, at least 1 mol % iodide. The benefit of the increase in light sensitivity is most apparent in combination with larger sized emulsions that are associated with increased granularity. Thus, it is preferred that the compounds of the invention are used with emulsions that have an equivalent circular diameter of at least 0.6 micrometer, or more preferably, at least 0.8 micrometer, or most preferably, at least 1.0 micrometer. In addition, the benefit of the invention is greatest in origination materials such as color negative or color reversal materials since they require higher sensitivity to light (because of the variable lighting conditions in natural scenes) and low granularity (due to high magnification) relative to color print materials for which exposure conditions are carefully controlled and which are viewed directly under low magnification conditions.

The polymers of the invention are also particularly useful when used in film elements that contain low overall silver levels. Thus, films containing 9 g/m$^2$ of total silver or less, or more preferably 5.4 g/m$^2$ or less or even 4.3 g/m$^2$ or less benefit from the use of the compounds of the invention.

In order to control and maintain granularity over a wide exposure range, it is a common practice to divide an individual color record into separate layers, each containing silver halide emulsions of different degree of sensitivity to the same color of light. While the polymer of the invention is most useful in the most light-sensitive layer, it can be used in more than one record that is sensitive to the same color of light. For example, in a color record that is split into three layers of different relative sensitivity; fast (F), mid (M) or slow (S), the compound can be used in each layer only or in any combination; i.e. F+M, F+M+S, F+S, etc. It is not necessary that these layers be adjacent; that is, they may have interlayers or even imaging layers that are sensitive to other colors located between them. In addition, although the most light-sensitive layer is typically located in the film structure closest to the exposure source and farthest from the support, the compounds of the invention allow for alternative locations of the layers; for example, a more light-sensitive layer containing the compound of the invention may be located below (farther from the exposing source) than a less sensitive layer. It is also possible to use the polymers of the invention in more than one color record at a time.

Moreover, when a number of layers of the same spectral sensitivity but of differing degrees of sensitivity to light are used, it is known that overall granularity can be minimized by using a smaller molar amount of dye-forming coupler than silver in the layers of higher sensitivity. Thus, it is preferred that the layers containing the compound of the invention additionally contain less than a stoichiometric amount of total dye forming coupler(s) relative to the amount of silver contained in the same layer. A suitable molar ratio of dye-forming coupler(s) to silver in the layer containing the compound of the invention would be less than 0.5. Most preferred would be a ratio of 0.2 or even 0.1 or less.

It is known that film elements can contain silver halide emulsions in one layer that have maximum sensitivities that are separated or shifted from emulsions in other layers that are sensitive to the same color of light (for example, a layer containing an emulsion with maximum sensitivity at ~530 nm whereas another layer contains a different green light-sensitive emulsion which is most sensitive at ~550 nm) are useful for increasing the amount of interimage and improving color reproduction. The layer containing the emulsions with shifted sensitivities may not contain any image couplers at all, but rather only inhibitor releasing couplers (DIRs or DIARs (Development Inhibitor Anchimeric Releasing couplers)) or colored masking couplers. The polymers of the invention are particularly useful in this type of application since they allow for the improved color reproduction while maintaining or increasing speed of the element.

The desired effect of the invention can also be obtained when the polymer of the invention is located in a non-silver containing light-insensitive layer, especially one that is preferably adjacent to an imaging layer, particularly the most sensitive layer of a multilayer record. Preferably, the light-insensitive layer is an interlayer located between two light-sensitive imaging layers. The interlayer can be located between two imaging layers sensitive to the same color or different. It is also possible that the interlayer containing the polymer is located between an imaging layer and an antihalation layer. The interlayer may also contain additional materials such as oxidized developer scavengers or colored organic filter dyes. It is preferred for this embodiment that the compound be located in a non-silver containing interlayer between the blue and green sensitive color records or a non-silver containing interlayer between the green and red sensitive color records. The non-light-sensitive layer containing a polymer of the invention cannot additionally contain either metallic silver or any type of finely divided silver salt.

Some polymers of the invention tend to increase the Dmin of the emulsion layer in which they are coated. Thus, it is often highly advantageous to use the compounds of the invention in combination with any of the antifoggants or scavengers known in the art to be useful in controlling Dmin or fog. Specific examples of scavengers for oxidized developers would be 2,5-di-t-octylhydroquinone, 2-(3,5-bis-(2-hexyl-dodecylamido)benzanido)-1,4-hydroquinone, 2,4-(4-dodecyloxybenzenesulfonamido)phenol, 2,5-dihydroxy4-(1-methylheptadecyl)benzenesulfonic acid or 2,5-di-s-dodecylhydroquinone. Specific examples of useful antifoggants are compounds AF-1 to AF-8 whose structures are shown below as well as 4-hydroxy-6-methyl-1,3,3a,7-tetraazaindene:

AF-1:

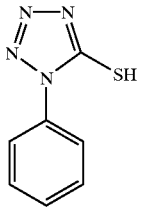

AF-2:

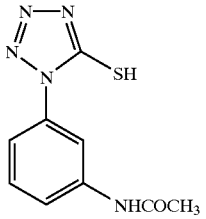

AF-3:

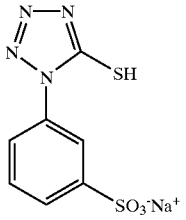

AF-4:

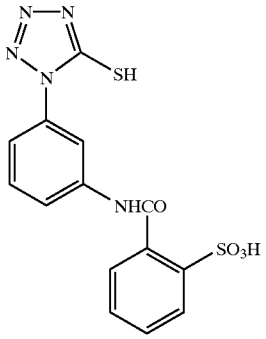

-continued

AF-5:

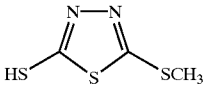

AF-6:

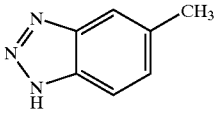

AF-7:

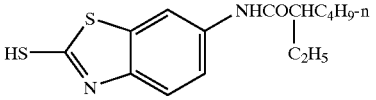

AF-8:

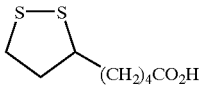

For the benzotriazoles of the invention, the hydrogen may be optionally replaced with a group that is removed in a non-imagewise fashion during the development step to regenerate the original N—H group. This offers the advantage of minimizing or avoiding undesirable interactions of the compound with the silver halide emulsion before processing. In this case, it is the Calculated logP of the unblocked monomeric heterocycle that is important and should be calculated with the hydrogen present and without the blocking group. Any of the temporary blocking groups known in the art to decompose in the developer in a non-imagewise manner can be used for this purpose. Particularly useful are those blocking groups that rely on some specific component of the developer solution to cause decomposition and regeneration of the original substituent. One example of this kind of blocking group, which relies on the hydroxylamine present in the developer, is described in U.S. Pat. No. 5,019,492.

Unless otherwise specifically stated or when the term "group" is used, it is intended throughout this specification, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine, iodine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy; 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino,p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy) butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfonyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

To control the migration of various components, it may be desirable to include a high molecular weight or polymeric backbone containing hydrophobic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

As used herein, the term "color photographic element" means any element containing a light-sensitive silver halide emulsion layer containing an image dye-forming coupler. They can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. A single color element may comprise a combination of couplers in one or more common layers which upon processing together form a monocolor, including black or gray, (so-called chromogenic black and white) dye image.

A typical color photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, or subbing layers.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light, absorbing and scattering materials, and physical property modifying addenda such as hardeners, coating aids, plasticizers, lubricants and matting agents are described, for example, in Sections II and VI through VIII. Color materials are described in Sections X through XII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, or color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color-developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613;

5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO0 250 201; EPO 0 271 323; EPO0 295 632; EPO 0 307 927; EPO 0 333 185; EPO 0 378 898; EPO 0 389 817; EPO 0 487 111; EPO 0488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color-developing agent are described in such representative patents and publications as: "Farbkuppler-eine Literature Ubersicht," published in Agfa Mitteilungen, Band III, pp. 126–156(1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672, EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192–350; German OLS 3,624,103; German OLS 3,912, 265; and German OLS 40 08 067. Typically such couplers are pyrazolones, pyrazoloazoles, or pyrazolobenzimidazoles that form magenta dyes upon reaction with oxidized color-developing agents.

Couplers that form yellow dyes upon reaction with oxidized color-developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color-developing agent are described in such representative patents as: UK. 861,138; U.S. Pat. Nos. 3,632, 345; 3,928,041; 3,958,993 and 3,961,959. Typically such couplers are cyclic carbonyl containing compounds that form colorless products on reaction with an oxidized color-developing agent.

Couplers that form black dyes upon reaction with oxidized color-developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color-developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. Nos. 4,301,235, 4,853, 319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58–172,647; U.S. Pat. Nos. 2,983, 608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163, 669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIRs). DIRs useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) that also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

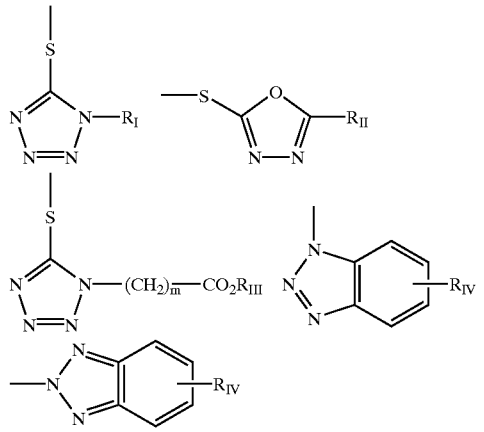

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features described above. It is typical that the timing group is of one of the formulas:

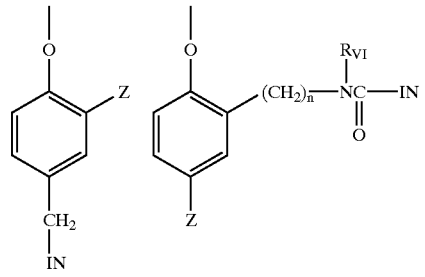

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light-sensitive emulsion layer include, but are not limited to, the following:

D1
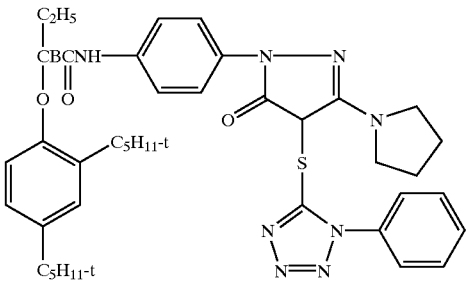
D2
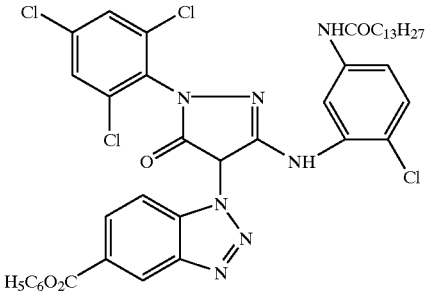
D3
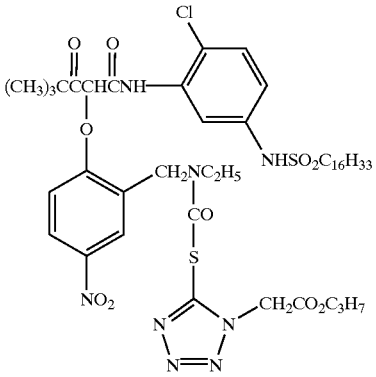
D4
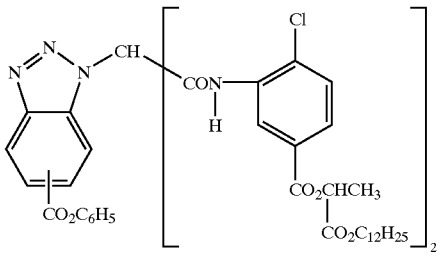
D5
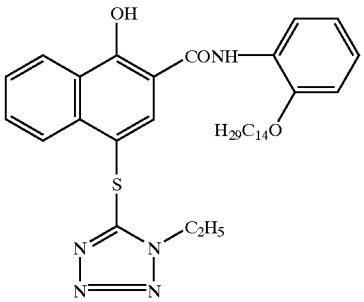
-continued
D6
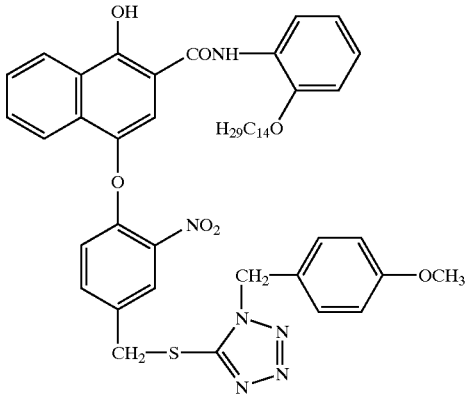
D7
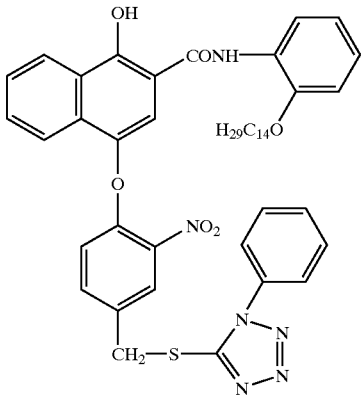
D8
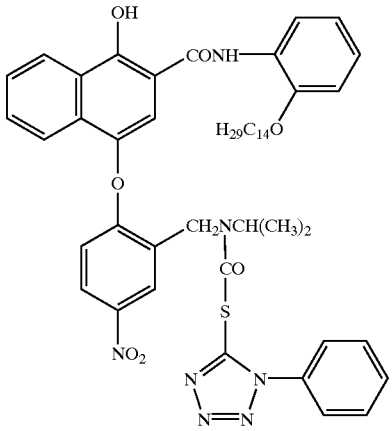
D9
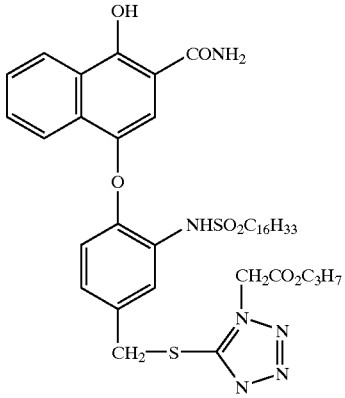

-continued

D10

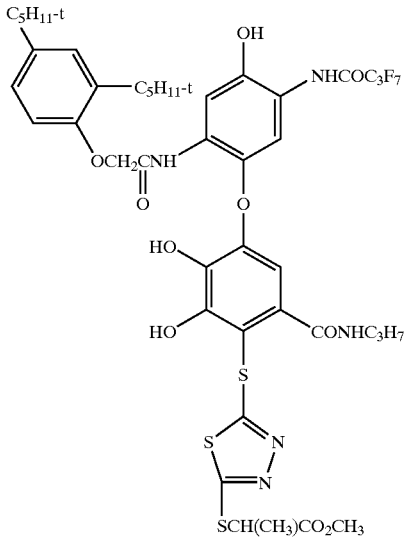

D11

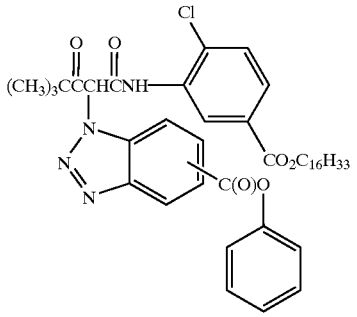

D12

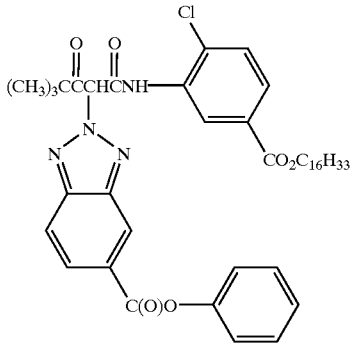

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). The major faces of the tabular grains can lie in either {111} or {100} crystal planes. Specifically contemplated tabular grain emulsions are those in which greater than 50 percent of the total projected area of the emulsion grains are accounted for by tabular grains having a thickness of less than 0.3 micrometer (0.5 micrometer for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al. U.S. Pat. No. 4,672,027 reports a 3 mol percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964, 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions consisting predominantly of silver chloride are useful and are described, for example, in U.S. Pat. Nos. 5,310,635; 5,320,938; and 5,356,764.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, 5,147,772, 5,147,773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color-developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41™ process as described in The British Journal of Photography Annual of 1988, pages 191–198. If a color negative film element is to be subsequently employed to generate a viewable projection print as for a motion picture, a process such as the Kodak ECN-2™ process described in the H-24 Manual available from Eastman Kodak Co. may be employed to provide the color negative image on a transparent support. Color negative development times are typically 3 minutes 15 seconds. The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6™ process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

Preferred color-developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Of the above, developers based on 4-amino-3-methyl-N-ethyl-N-(2-hydroxyethyl)aniline and 4-amino-3-methyl-N-ethyl-N-(2-methanesulfonamidoethyl)aniline are especially preferred. Moreover, because the compounds of the invention give increased light sensitivity, they are especially useful in processes that have shortened development times. In particular, the film elements of the invention can be processed with development times of less than 3.25 minutes or even less than 3 minutes or in extreme cases, even less than 120 seconds.

Development is usually followed by the conventional steps of bleaching, fixing, or bleach-fixing, to remove silver or silver halide, washing, and drying.

The entire contents of the patents and other publications referred to in this specification are incorporated herein by reference.

SYNTHESIS EXAMPLES

Synthesis of Benzotriazole Monomer B1-1:

Mercaptoacetic acid (9.2 g, 0.1M) was added over 5 minutes to a stirred solution of potassium hydroxide (12.3 g, 0.22M) in methanol (40 ml). 4-Vinylbenzyl chloride (15.25 g, 0.1M) was then added over 5 minutes during which an exothermic reaction ensued and the mixture turned yellow. The mixture was stirred at room temperature for 5 minutes, then it was heated under reflux on a steam-bath for 1 hour. After being allowed to cool, the mixture was concentrated under reduced pressure to leave a yellow solid. 3M Hydrochloric acid (100 ml) was added to the solid and this mixture was stirred at room temperature for 2 hours. The resulting cream solid was filtered off, washed with water and dried, 20.0 g. The solid was stirred with 60–80 petroleum-ether (60 ml) for 2 hours then the resulting white solid was filtered off, washed with 60–80 petroleum-ether and dried to give 4-vinylbenzylthioacetic acid, 17.8 g (85%). The negative ion mass spectrum was consistent with the structure of the required product as was the 1H nmr spectrum, which also indicated high purity. LCMS showed a single component of the requisite molecular weight.

Oxalyl chloride (2.79 g, 0.022M) was added rapidly to a stirred solution of the above thioacetic acid (4.16 g, 0.02M) in dichloromethane (25 ml). The mixture immediately turned yellow and was stirred at room temperature for 40 minutes. The evolution of gases was slow, so N,N-dimethylformamide (3 drops) was added and rapid evolution of gases ensued immediately. The solution was stirred for a further 1 hour (evolution of gases had stopped after about 45 minutes), then it was concentrated under reduced pressure to leave a pale yellow oil, 5.1 g (>100%, contains dichloromethane). The 1H nmr spectrum and the infrared spectrum were consistent with the structure of the required product, but the nmr spectrum shows the presence of some dichloromethane.

A solution of the above acid chloride (ca. 0.02M) in tetrahydrofuran (10 ml) was added over 8 minutes to a stirred solution of 7-aminobenzotriazole (2.5 g, 0.019M) in pyridine (20 ml). The mixture was stirred at room temperature for 4 hours, then 0.88M ammonia (0.5 ml) was added and stirring was continued for another 20 minutes. The mixture was poured into ice/water (200 ml) to give an oil which soon solidified. 10M Hydrochloric acid (25 ml) was added and the acidified mixture was stirred for 5 minutes before the resulting pink solid was filtered off, washed with water and dried, 5.8 g. The solid was added to methanol (25 ml) and the suspension was stirred at room temperature for 1 hour. Filtration of the mixture resulted in removal of most of the colour from the solid, which was further washed with methanol and dried, 4.3 g. The solid was heated briefly on a steam-bath with tetrahydrofuran (50 ml) to give a cloudy solution. This was cooled and filtered through Kieselguhr and the filtrate was concentrated under reduced pressure to leave an off-white solid. Methanol (25 ml) was added and the mixture was stirred at room temperature for 2 hours, then the resulting white solid was filtered off, washed with methanol and dried to give B1-1, 15 g (52%). The positive and negative ion electrospray mass spectra were consistent with the structure of the required product. LCMS indicated purity of >98%, which was also supported by the 1H-nmr spectrum.

Synthesis of Polymer P-1:

A vial was charged with B2-1 (0.56 g, 3.0 mmole), acrylamide (1.26 g, 17.8 mmole), CM-a-6 (0.64 g, 3.0 mmole), sodium 2-acrylamido-2-methyl-1-propanesulfonate (IM-2; 0.29 g, 1.25 mmole), water (2.0 g), dimethylformamide (22 g) and 2,2-azobisisobutyronitrile (0.024 g), purged with argon, sealed and heated at 60° C. for 24 hours. The contents were then poured in to ethyl acetate (~200 ml), the precipitate was filtered, air dried, extracted for three hours with an 80/20 THF/DMF solvent mixture to remove unpolymerized benzotriazole and then filtered and rinsed with THF. The polymer was dissolved in a DMF/water mixture and dialyzed 24 hours to remove the DMF. The final aqueous solution was 93 g at 2.04% solids. The yield was 1.90 g or 69%.

Synthesis of Polymer P-3:

A vial was charged with B1-1 (2.08 g, 6.4 mmole), sodium styrenesulfonate (IM-12; 1.98 g, 9.6 mmole), water (2.0 g), dimethylformamide (27 g) and 2,2-azobisisobutyronitrile (0.024 g), purged with argon, sealed and heated at 60° C. for 24 hours. The contents were then poured in to THF (~250 ml), the precipitate was filtered and rinsed with THF. The polymer was dissolved in a DMF/water mixture and dialyzed 24 hours to remove the DMF. The final aqueous solution was 137 g at 1.75% solids. The yield was 2.4 g or 59%.

Photographic Examples

Monochrome films demonstrating the invention were produced by coating the following layers over a gelatin pad of 2.7 on a cellulose triacetate film support (all coverages are in grams per meter squared):

Layer 1 (Overcoat): gelatin at 2.7 and bis-(vinylsulfonyl) methylether hardener at 0.20.

Layer 2 (Fast Magenta Layer): gelatin at 2.7; M-1 at 0.084, DIR-1 at 0.003 and a green sensitized silver iodobromide emulsion at 1.296 and the polymer (when present) at 0.0807 mmoles/$m^2$ (based on the benzotriazole subunit).

Layer 3 (Mid Magenta Layer): gelatin at 1.57; M-1 at 0.059; DIR-1 at 0.011, MC-1 at 0.108 and a green sensitized silver iodobromide emulsion at 0.972.

Layer 4 (Slow Magenta Layer): gelatin at 1.188; M-1 at 0.281; MC-1 at 0.0756 and a combination of two silver iodobromide emulsions at a total of 0.875.

Formulas for materials used in the above format are as follows:

DIR-1:

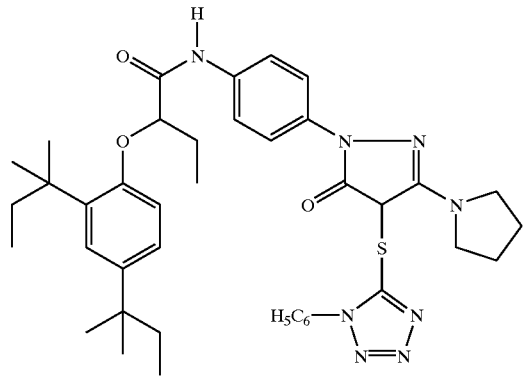

MC-1:

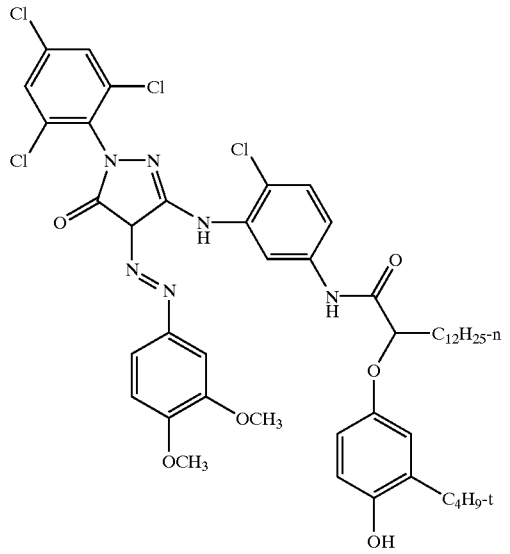

The comparative polymers used were as follows:

TABLE 1

Comparative Polymers

| Sample | % Benzotriazole Monomer | % Monomer of Formula (CM' | % Monomer of Formula (IM') |
|---|---|---|---|
| CP-1[1] | None | 20% p-t-butylstyrene | 80% IM'-12 |
| CP-2[1] | None | 40% p-t-butylstyrene | 60% IM'-12 |
| CP-3 | 20% B2-1 | None | 80% IM'-12 |
| CP-4 | 40% B2-1 | None | 60% IM'-12 |
| CP-5 | 6.3% B2-1 | 93.7% Acrylamide | None |
| CP-6 | 11.9% B2-1 | 88.1% Acrylamide | None |
| CP-7 | 12% B2-1 | 83% Acrylamide | 5% IM'-1 |
| CP-8 | 6.3% B2-1 | 83.7% Acrylamide 5.0% CM'-a-6 | 5% IM'-1 |

[1]Laydown of 0.0807 mmol/m$^2$ based on the p-t-butylstyrene

Additional samples were prepared as above except the comparative or inventive test compounds were added directly to Layer 2 at the indicated levels in g/m$^2$ immediately before coating. These samples were given a stepwise exposure and processed in the KODAK FLEXICOLOR™ (C41) process as described in British Journal of Photography Annual, 1988, pp196–198 except that the temperature was 32.2° C. and the time of development was 2 minutes. Relative Speed or light sensitivity (Δ Speed), given in terms of a fraction of a stop (1 stop is a doubling of light sensitivity), was determined by comparing the exposure point +0.15 density units above Dmin to the check position without addenda under the same conditions.

TABLE 2

Benzotriazole Polymers in Light-Sensitive Imaging Layers

| Sample | Comparative or Inventive | Ad-denda | BTAZ Calculated logP | CM' Calculated logP | Δ Green Dmin | Δ Green Speed |
|---|---|---|---|---|---|---|
| A-1 | Comp | CP-1 | | 4.80 | −0.005 | −0.07 |
| A-2 | Comp | CP-2 | | 4.80 | −0.009 | +0.03 |
| A-3 | Comp | CP-3 | 0.63 | | −0.030 | −0.01 |
| A-4 | Comp | CP-4 | " | | +0.001 | −0.09 |
| A-5 | Comp | CP-5 | " | −0.81 | −0.012 | −0.24 |
| A-6 | Comp | CP-6 | " | −0.81 | −0.004 | −0.26 |
| A-7 | Comp | CP-7 | " | −.081 | −0.022 | −0.03 |
| A-8 | Comp | CP-8 | " | −0.81 + 4.08 | −0.016 | −0.04 |
| A-9 | Inv | P-1 | " | −0.81 + 4.08 | −0.015 | +0.08 |
| A-10 | Inv | P-2 | " | −0.81 + 1.34 | +0.005 | +0.06 |
| A-11 | Inv | P-3 | 3.62 | | −0.007 | +0.20 |
| A-12 | Inv | P-4 | " | | −0.013 | +0.19 |

The results in Table 2 show that Samples A-1 and A-2 which contain polymers without any benzotriazole subunits fail to increase speed significantly. The speed results for Samples A-3 to A-7 show only speed losses with polymers derived from a benzotriazole monomer with a Calculated logP of less than 3.1 and co-monomers with Calculated logP less than 0.5. Sample A-8 contains a polymer derived from a benzotriazole with Calculated logP of less than 3.1 and a low level of a CM which is insufficient to increase speed. However, simply increasing the level of the same CM, as in sample A-9, provides the desired speed increase by increasing the overall hydrophobicity of the polymer. Sample A-10 demonstrates the same result by the addition of a different CM. Samples A-11 and A-12 show that the speed is increased when the Calculated logP of the corresponding benzotriazole monomer is greater than 3.1 as compared to Samples A-3 and A-4 where the benzotriazole monomer has a Calculated logP of less than 3.1.

The invention has been described in detail with particular reference to preferred embodiments thereof, but it will be understood that variations and modifications can be effected within the scope and spirit of the invention.

What is claimed is:

1. A color silver halide photographic element comprising a light-sensitive silver halide emulsion layer or a non-silver containing light-insensitive layer, said light-sensitive or light-insensitive layer containing a polymer compound comprising a repeating benzotriazole subunit wherein a) the benzotriazole monomer corresponding to the benzotriazole subunit has a Calculated logP of at least 3.1 and less than 6.2; or b) the benzotriazole monomer corresponding to the benzotriazole subunit has a Calculated logP of less than 3.1 and the polymer additionally comprises a co-monomer with Calculated logP of 0.5 or greater;

and the amount of the polymer compound in the element is sufficient to increase the photographic speed of the element compared to the same element without the polymer compound.

2. The color photographic element of claim 1 wherein the polymer compound is present in a light-sensitive silver halide emulsion layer.

3. The color photographic element of claim 2 wherein the light-sensitive layer is the most sensitive layer of two or more layers having the same spectral sensitivity.

4. The color photographic element of claim 1 wherein the polymer compound is present in a non-silver containing light-insensitive layer.

5. The color photographic element of claim 4 wherein the light-insensitive layer is adjacent to a light-sensitive layer.

6. The color photographic element of claim 5 wherein the light-sensitive layer is the most light-sensitive of two or more light-sensitive layers of the same spectral sensitivity.

7. The color photographic element of claim 1 wherein the polymer is present in an amount sufficient to increase the speed of a neutral exposure by at least 0.1 of a stop compared to the same element without the compound.

8. A color silver halide photographic element comprising a light-sensitive silver halide emulsion layer or a non-silver containing light-insensitive layer, said light-sensitive or light-insensitive layer containing a polymer compound comprising a repeating benzotriazole subunit wherein the corresponding benzotriazole monomer has a Calculated logP of at least 3.1 and less than 6.2 and the amount of the polymer compound in the element is sufficient to increase the photographic speed of the element compared to the same element without the compound.

9. The color photographic element of claim 8 wherein the polymer compound is present in a light-sensitive silver halide emulsion layer.

10. The color photographic element of claim 8 wherein the polymer compound is present in a non-silver containing light-insensitive layer.

11. The color photographic element of claim 8 wherein the polymer is present in an amount sufficient to increase the speed of a neutral exposure by at least 0.1 of a stop compared to the same element without the compound.

12. The color photographic element of claim 8 wherein the polymer additionally contains a group derived from an ionizable monomer substituted with an ionizable functional group selected from the group consisting of sulfonates, sulfates, phosphates, and carboxylic acids.

13. The color photographic element of claim 12 where the ionizable monomer is represented by Formula (IM'):

(IM')

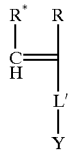

wherein R' is hydrogen, or a carbonyl, alkyl or aryl group; R* is hydrogen, or an alkyl or carbonyl group and may be connected with R' to form a ring system, L' is a linking group chosen from the group of —O—, —S—, —NH—, —$CH_2$— or —$SO_2$—; and Y is a ionizable sub-unit group chosen from the sulfonates, sulfates, phosphates, carboxylates, thiosulfates and sulfinates.

14. The color photographic element of claim 13 wherein the ionizable monomer is chosen from the group consisting of

IM'-1:

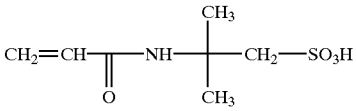

IM'-2:

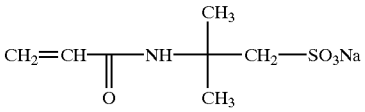

IM'-6: $CH_2{=}CH{-}SO_3Na$

IM'-12:

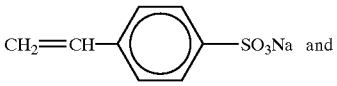

and

IM'-14:

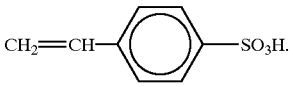

15. The color photographic element of claim 8 wherein the benzotriazole monomer is according to Formula (A')

(A')

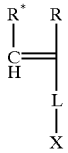

wherein R is hydrogen or a cyano, carbonyl, alkyl or aryl group, R* is hydrogen or a carbonyl, alkyl or aryl group and may be connected with R to form a ring system, L is a linking group and X is a benzotriazole group.

16. The color photographic element of claim 15 wherein R is hydrogen or a methyl group and the linking group L is chosen from the groups represented by Formulas L-1 and L-2:

(L-1)

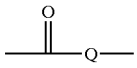

(L-2)

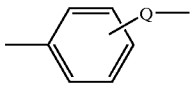

where Q is an oxygen atom, a sulfur atom, a nitrogen atom, a methylene group or a carbonyl group.

17. The color photographic element of claim 16 wherein the —L—X group is represented by Formula (b1):

(b1)

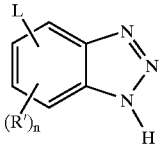

where L is according to either L-1 or L-2, n is 0–3 and R' is hydrogen or any substituent chosen from the group of vinyl, acetylenic, alkyl, aryl, alkoxy, aryloxy, alkylthio or arylthio, sulfoxyl, sulfonyl, sulfamoyl, fluoro, chloro, bromo, iodo, cyano, nitro, —O—CO—, —O—$SO_2$—, heterocycles, keto, carboxylic acid, carboxylate ester, carbamoyl, amino, carbonamido, sulfonamido, hydroxyl and thiol groups.

18. The color photographic element of claim 17 wherein the benzotriazole group is chosen from the group consisting of

B1-1:

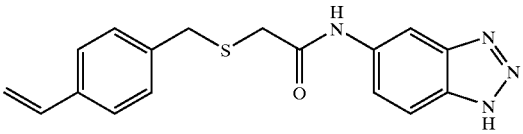

B1-2:

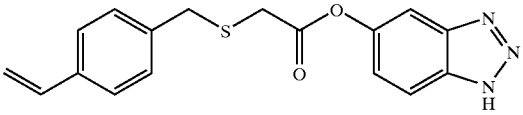

-continued

B1-3:

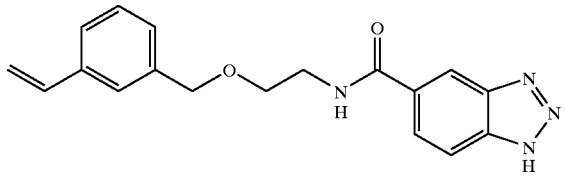

B1-5:

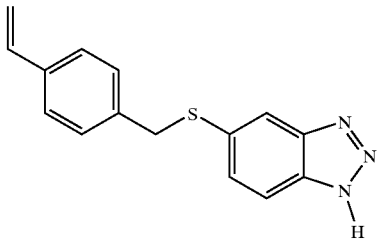

and

B1-8:

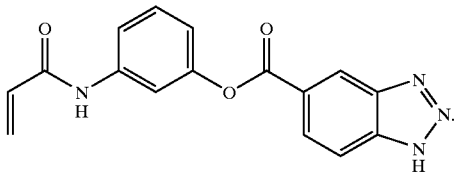

19. A color silver halide photographic element comprising a light-sensitive silver halide emulsion layer or a non-silver containing light-insensitive layer, said light-sensitive or light-insensitive layer containing a polymer compound comprising a repeating benzotriazole subunit wherein the benzotriazole monomer corresponding to the benzotriazole subunit has a Calculated logP of less than 3.1, and a co-monomer with Calculated logP of 0.5 or greater;

wherein the amount of the polymer compound in the element is sufficient to increase the photographic speed of the element compared to the same element without the compound.

20. The color photographic element of claim 19 wherein the polymer compound is present in a light-sensitive silver halide emulsion layer.

21. The color photographic element of claim 19 wherein the polymer compound is present in a non-silver containing light-insensitive layer.

22. The color photographic element of claim 19 wherein the polymer is present in an amount sufficient to increase the speed of a neutral exposure by at least 0.1 of a stop compared to the same element without the compound.

23. The color photographic element of claim 19 wherein the benzotriazole monomer is represented by Formula (A')

(A')

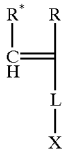

where R is hydrogen or a cyano, carbonyl, alkyl or aryl group, R* is hydrogen or a carbonyl, alkyl or aryl group and may be connected with R to form a ring system, L is a linking group and X is a benzotriazole group.

24. The color photographic element of claim 23 wherein R is hydrogen or a methyl group and the linking group L is chosen from the groups represented by Formulas L-1 and L-2:

(L-1)

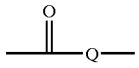

(L-2)

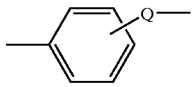

where Q is an oxygen atom, a sulfur atom, a nitrogen atom, a methylene group or a carbonyl group.

25. The color photographic element of claim 24 wherein the —L—X is represented by Formula (b1):

(b1)

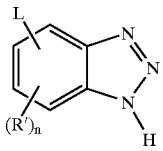

where L is according to either L-1 or L-2, n is 0–3 and R' is hydrogen or any substituent chosen from the group of vinyl, acetylenic, alkyl, aryl, alkoxy, aryloxy, alkylthio or arylthio, sulfoxyl, sulfonyl, sulfamoyl, fluoro, chloro, bromo, iodo, cyano, nitro, —O—CO—, —O—$SO_2$—, heterocycles, keto, carboxylic acid, carboxylate ester, carbamoyl, amino, carbonamido, sulfonamido, hydroxyl or thiol.

26. The color photographic element of claim 25 wherein the polymer further comprises a co-monomer represented by the Formula CM':

(CM′)

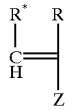

where R" is hydrogen, cyano, alkyl or aryl group, R* is hydrogen, carbonyl, alkyl or aryl and may be connected with R to form a ring system and Z is an aryl group, an oxygen atom, a nitrogen atom or a carbonyl group.

27. The color photographic element of claim 26 wherein the Calculated logP of the co-monomer has a Calculated logP of 3.75 or greater.

28. The color photographic element of claim 27 wherein Z is an aryl group.

29. The color photographic element of claim 26 wherein Z is an oxygen atom and the Calculated logP of the co-monomer is 1.00 or greater.

30. The color photographic element of claim 26 wherein Z is a nitrogen atom and the Calculated logP of the co-monomer is 1.00 or greater.

31. The color photographic element of claim 26 wherein Z is a carbonyl group according to the Formula (CM'-a):

(CM′-a)

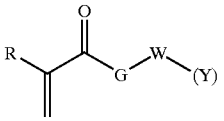

where R is hydrogen or a methyl group, G is an oxygen or nitrogen atom, W is an alkyl or aryl group, and Y is hydrogen or an ionizable water-solubilizing group.

32. The color photographic element of claim 31 wherein G is an oxygen atom and the Calculated logP of the co-monomer is 3.2 or greater.

33. The color photographic element of claim 31 wherein G is a nitrogen atom and the Calculated logP of the co-monomer is 2.2 or greater.

34. The color photographic element of claim 31 wherein the co-monomer (CM'-a) is more than 5% by weight of the total amount of polymer.

35. The element of claim 1 wherein the element is an origination material for capturing an original image.

36. The color photographic element of claim 35 in which the most light sensitive silver halide emulsion is a silver iodobromide emulsion of greater than 1.0 micron average grain size.

37. The color photographic element of claim 8 wherein the ratio of the number of millimoles of the polymer (based on the benzotriazole unit) to the number of moles of silver in the same layer is at least 1.0.

38. The color photographic element of claim 19 in which the polymer is present at a laydown of $3.0\times10^{-5}$ mol/m$^2$ (based on the benzotriazole unit) or greater.

39. A process for forming a photographic image, comprising contacting with a p-phenylenediamine color developer the photographic element as described in claim 1.

40. The process of claim 39 wherein the color developer comprises 2-[(4-amino-3-methylphenyl)ethylamino]ethanol or 4-amino-3-methyl-N-ethyl-N-(2-methanesulfonamidoethyl)aniline.

* * * * *